US008937634B2

(12) United States Patent
Morgan et al.

(10) Patent No.: US 8,937,634 B2
(45) Date of Patent: Jan. 20, 2015

(54) PRINTING APPARATUS

(75) Inventors: Jonathan Morgan, Cambridge (GB); Ebbe Kiilerich, Copenhagen NV (DK); Kristian Van Jorgensen, Lyngby (DK)

(73) Assignee: Domino Printing Sciences PLC (GB)

( * ) Notice: Subject to any disclaimer, the term of this patent is extended or adjusted under 35 U.S.C. 154(b) by 0 days.

(21) Appl. No.: 13/824,557

(22) PCT Filed: Oct. 19, 2011

(86) PCT No.: PCT/GB2011/052020

§ 371 (c)(1),
(2), (4) Date: Jun. 24, 2013

(87) PCT Pub. No.: WO2012/052756

PCT Pub. Date: Apr. 26, 2012

(65) Prior Publication Data

US 2013/0271548 A1 Oct. 17, 2013

(30) Foreign Application Priority Data

Oct. 19, 2010 (GB) ..... 1017594.1

(51) Int. Cl.
*B41J 2/335* (2006.01)
*B41J 25/312* (2006.01)
*B41J 29/393* (2006.01)

(52) U.S. Cl.
CPC ..... *B41J 25/312* (2013.01); *B41J 29/393* (2013.01)
USPC ..... 347/198

(58) Field of Classification Search
USPC ..... 347/197, 198; 400/234
See application file for complete search history.

(56) References Cited

U.S. PATENT DOCUMENTS

| | | | | |
|---|---|---|---|---|
| 5,612,727 | A | 3/1997 | Morimoto et al. | |
| 6,337,959 | B1 | 1/2002 | Kwak et al. | |
| 2005/0105950 | A1 * | 5/2005 | Ullenius et al. | 400/234 |
| 2009/0040262 | A1 | 2/2009 | Watanabe | |

FOREIGN PATENT DOCUMENTS

| | | |
|---|---|---|
| EP | 1097814 | 5/2001 |
| EP | 1691177 | 8/2006 |
| GB | 2294907 | 5/1996 |
| JP | 62176855 | 8/1987 |
| JP | 2070452 | 3/1990 |
| JP | 11208058 | 8/1999 |
| JP | 2000085202 | 3/2000 |
| JP | 4128053 | 5/2008 |
| WO | 2005051664 | 6/2005 |

OTHER PUBLICATIONS

State Intellectual Property Office of People'S Republic of China, First Office Action, Sep. 2, 2014.

* cited by examiner

*Primary Examiner* — Kristal Feggins
(74) *Attorney, Agent, or Firm* — Price Heneveld LLP

(57) ABSTRACT

The invention provides a method of controlling the pressure applied to a substrate being printed by a thermal transfer printing head. The head displacement facility includes a resilient member such as a spring which undergoes deflection as the print head engages the substrate. The method comprises monitoring both print head position and spring deflection to control the pressure applied by the print head.

8 Claims, 4 Drawing Sheets

PRINTING APPARATUS

FIELD OF THE INVENTION

This invention relates to printing apparatus and, in particular, to thermal transfer printing apparatus.

BACKGROUND TO THE INVENTION

Thermal transfer overprinting apparatus normally includes a thermal printing head having a linear or 2-dimensional array of thermal elements. In use the thermal printing elements are selectively energised in accordance with data representative of an image to be printed, e.g. the output data from a computer, or a scanning device. The thermal head is brought into contact with a ribbon or tape bearing a hot melt ink or wax, sandwiching the ribbon or tape between the thermal head and a substrate. The selective energising of the elements in the thermal head then initiates transfer of the hot melt ink from the ribbon to the substrate.

It is recognised by those versed in the art that the print quality provided by a thermal printing head is highly dependent on the pressure applied by the thermal head to the substrate being printed, via the ribbon.

Many different forms of apparatus have been proposed to control the pressure applied by the print head to the substrate. One common form of apparatus uses compressed air delivered via a pneumatic circuit, in combination with a solenoid operated device, to control the air pressure. This method has the drawback that it is difficult to vary the pressure setting to account for different qualities and/or different thicknesses of substrate to be printed.

Another form of apparatus is described in Japanese Patent Application No. 4128053 which teaches the use of resilient means in the form of a compressed spring to generate a pressure between head and substrate. Yet another example is described in British Patent Application No. 2 294 907 which teaches the use of a stepper motor, in conjunction with resilient means, to drive a printing head into contact with a substrate, for a predetermined number of steps, to achieve a desired pressure.

There are a number of drawbacks with the prior art described. Among these are that the pressure applied depends to an extent on the hardness of the substrate. This problem can generally be overcome by means of calibration, and control of the various means that are available to enter and store printing settings into a control computer. Another problem with prior art forms of apparatus is that the control mechanisms for applying pressure are one-sided in that they compensate for a substrate becoming thinner by stepping the head is down. It will be appreciated, however, that pressure will increase if the substrate becomes thicker. As a consequence, typical applications for printers of this type are restricted to substrates whose thickness is well controlled, and largely flat. Further, in use, the printing head must be withdrawn between prints, thereby resetting the pressure applied.

It is an object of the present invention to provide thermal printing apparatus which goes at least some way in minimising the above-mentioned problems; or which will at least provide a novel and useful choice.

SUMMARY OF THE INVENTION

Accordingly, in one aspect, the invention provides a method of controlling the pressure applied by a print head forming part of a thermal transfer printing apparatus, said apparatus including a support surface for the substrate to be printed, a thermal printing head, and drive means to move said thermal printing head towards said support surface, said drive means including a resiliently deformable member which undergoes deformation upon said printing head contacting a substrate on said support surface, said method being characterised in that it includes sensing the position of said print head and the deformation of said resiliently deformable member.

Preferably said drive means includes a stepping motor and wherein the deformation of said resilient member is determined using a control loop dependent upon the response of electro-magnetic sensors detecting magnets positioned to monitor the displacement of said print head.

Preferably said method further includes undertaking a calibration function to ensure that deformation of said resilient member is determined when the responses of said electro-magnetic sensors as a function of printing head movement are substantially linear.

Preferably said method includes undertaking a further calibration to ensure a constant deformation of said resilient member independent of temperature.

In a second aspect the invention provides a thermal transfer printing apparatus having a support surface for the substrate to be printed, a thermal printing head, and drive means to move said thermal printing head towards said support surface, said apparatus being characterised in it includes a resiliently deformable member within said drive means which undergoes deformation upon said printing head contacting a substrate on said support surface; and one or more sensors to monitor the position of said print head and the deformation of said resiliently deformable member.

Preferably said one or more sensors comprise electro-magnetic sensors.

Preferably said electro-magnetic sensors comprise Hall effect sensors.

Many variations in the way the present invention can be performed will present themselves to those skilled in the art. The description which follows is intended as an illustration only of one means of performing the invention and the lack of description of variants or equivalents should not be regarded as limiting. Wherever possible, a description of a specific element should be deemed to include any and all equivalents thereof whether in existence now or in the future.

BRIEF DESCRIPTION OF THE DRAWINGS

One working embodiment of thermal transfer apparatus incorporating the various aspects of the invention will now be described with reference to the accompanying drawings in which.

DESCRIPTION OF WORKING EMBODIMENT

Figure 1:
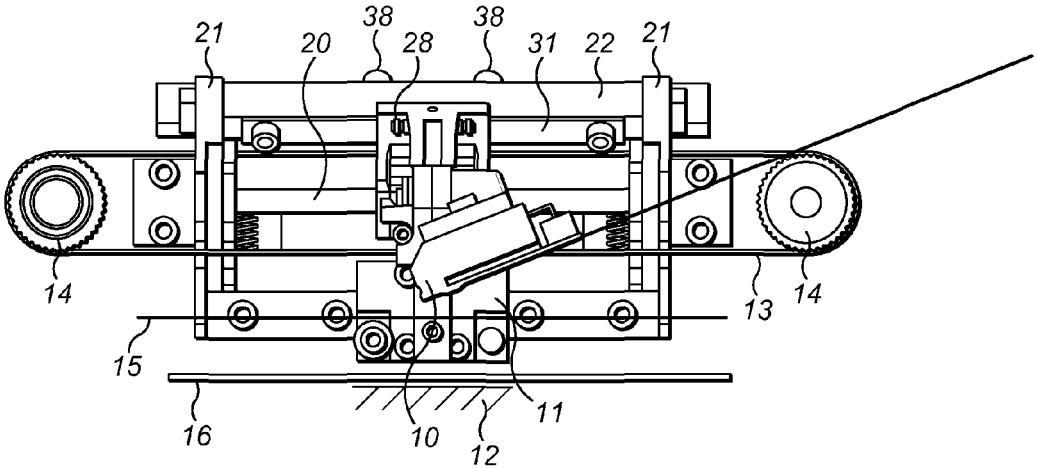
FIG. 1: shows an elevational view, from the front, of thermal transfer printing apparatus according to the invention.
Figure 2:
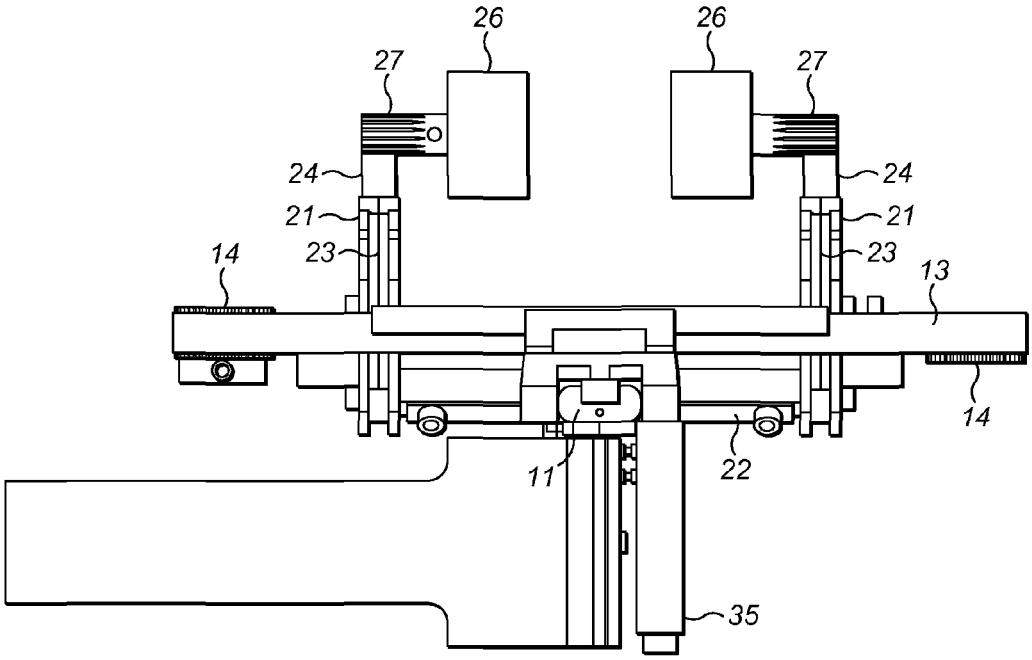
FIG. 2: shows a plan (opposite sided) view of that which is shown in FIG. 1.
Figure 3:
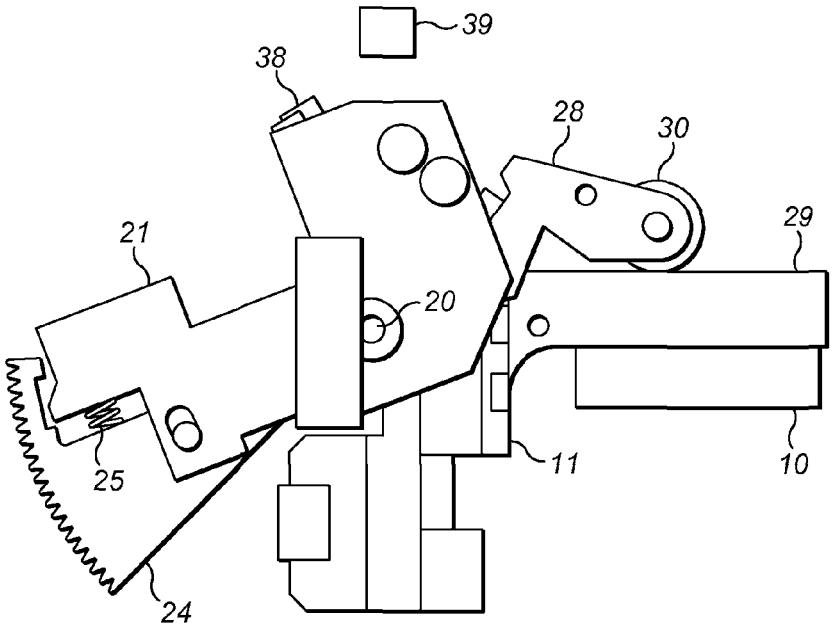
FIG. 3: shows an end schematic view of a tilting mechanism used to displace the print head in a vertical direction, in an 'up' position.
Figure 4:
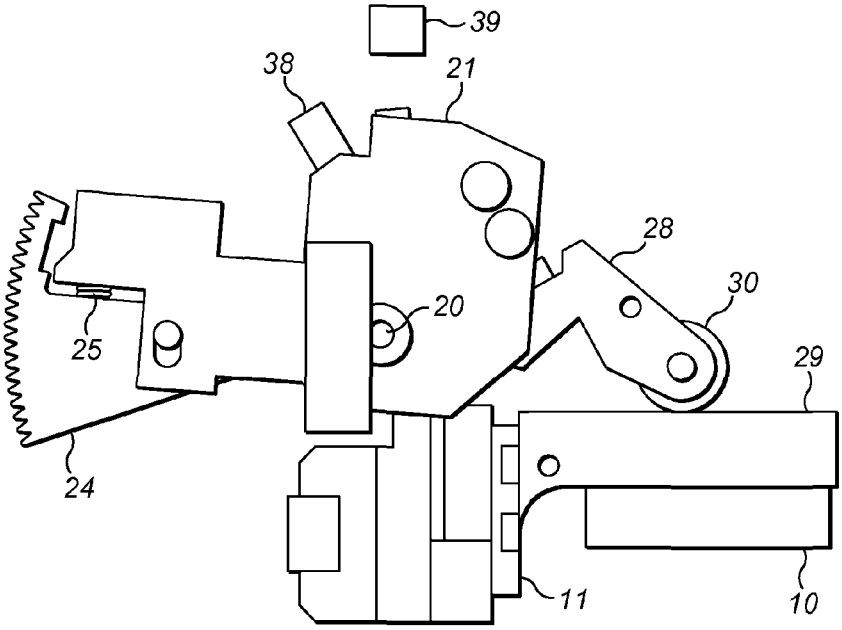
FIG. 4: shows a view similar to FIG. 3 but with the print head in a 'down' position.

FIGS. 1 to 4 show a preferred form of a thermal transfer printing apparatus which embodies the various aspects of the invention. In the form shown a thermal print head 10 is attached to a carriage 11 that allows the print head to move in a vertical direction towards and away from a substrate support 12. The substrate support 12 may be part of the apparatus or may be provided as part of the environment in which, in use, the apparatus is mounted.

The carriage 11, in turn, is attached to a drive belt 13 that allows the print head to be moved in both directions along a horizontal axis. To this end the belt is mounted on a pair of spaced rollers 14 and it will be appreciated that the direction of rotation of the rollers 14 determines the direction of movement of the carriage 11 in a horizontal direction.

In the conventional manner, lowering the print head 10 toward the substrate support 12, displaces an ink-impregnated ribbon or tape 15 into contact with a substrate 16 supported by the substrate support 12. Elements within the print head 10 are then selectively activated to heat and transfer ink from the tape 15 to the substrate 16.

Vertical movement of the carriage 11 is, in the form shown, effected by a tilting unit mounted on pivot rod 20. The tilting unit comprises a pair of end assemblies 21 rotatably mounted on pivot rod 20. The end assemblies 21 are interconnected by rail bar 22 to ensure that the end assemblies pivot together. Defined in each assembly 21 is a slot 23, mounted within which is a geared segment 24 which can slide in a vertical direction with respect to the slot in which it is mounted. A resilient member, preferably a coil spring 25, is disposed between each geared segment 24 and its respective end assembly 21 so that displacement of the geared segment 24 can be transferred to the end assembly in which it is mounted.

A pair of stepper motors 26 are provided having output pinions 27 which engage the geared segments 24. Thus, operation of the stepper motors causes displacement of the geared segments and thus rotation of the end assemblies 21 and rail bar 22 about the pivot bar 20.

The rotation of the rail bar 22 is transferred to carriage 11 by means of a fork assembly 28 which is also mounted on the pivot bar 20 and which is displaced by the rail bar 22 into contact with lever bar 29, extending from the carriage 11, through a bearing 30. It will be appreciated that the fork 28 surrounds the carriage 11 and, with the carriage 11, is displaceable in a horizontal direction upon operation of the rollers 14 driving belt 13. Thus the rail bar 22 has a bearing surface 31 on the under-side thereof to allow the efficient displacement of the carriage 11 in a vertical direction, regardless of the horizontal position of the carriage.

The means for controlling the tension the ribbon or tape 15 does not form part of the invention but may comprise a combination of ribbon tensioner 35 and a tension control system of the type described in European Patent Application No. EP99900447.6, which is published as EP-A-1,051,299.

At its broadest, the invention controls the pressure of the print head against the substrate, by monitoring movement of the print head and compression of the springs 25. In this way, a constant pressure on the substrate can be maintained irrespective of the thickness of the substrate Advantageously a pair of magnets 38 are mounted on the rail bar 22 and by using electro-magnetic sensors 39 such as Hall effect sensors, mounted above the bar 22 so as to interact with the magnets 38, the rotational position of the rail bar 22 can be measured and the vertical position of the print head 10 thus deduced.

As the stepper motors 26 rotate to displace the print head down into contact with the tape 15 and substrate 16, all movement of the geared segments 24 is initially transferred to the end assemblies 21 via the springs 25. Upon contact of the print head with the tape and substrate, there will be a slight compression of the substrate until equilibrium is reached, and then further operation of the stepper motors 26 will cause deflection of the springs 25 to apply a pressure to the substrate via the print head 10. The method and means for controlling this pressure is described below.

Figure 5:
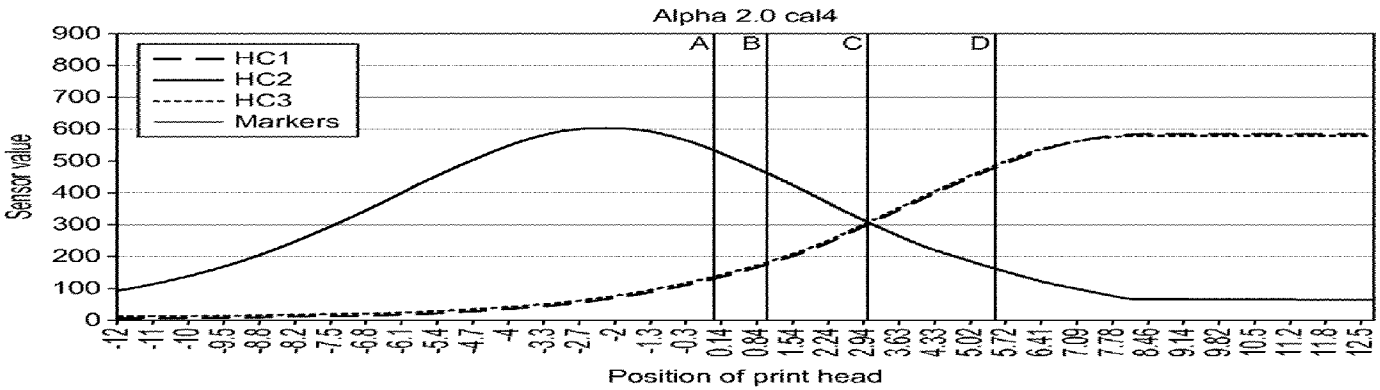
FIG. 5: shows the responses of three sensors as a function of print head position collected in a calibration phase.

At the initialisation of the printer, and without a substrate in place, the printer will cause the stepper motors 26 to rotate thereby driving the head down. As shown in FIG. 5, the responses from the Hall effect sensors 39 are collected at various positions as the print head moves down, and are stored electronically for subsequent access by a micro-computer which controls the operation of the printer. The data is stored as a look-up table that relates sensor value to print head position.

The position of the print head 10 relative to stepper motor position is determined by the precise dimensions of the gear segments 24 and the geometry of the tilt mechanism, fork assembly 28, and carriage 11. A straightforward calculation can therefore be performed to convert stepper motor steps into print head displacement in a vertical direction.

FIG. 5 shows four vertical lines A, B, C, D. A represents a reference plane in line with the ribbon or tape 15 (hereinafter referred to as the base) whilst B, C, and D represent, respectively, positions 1 mm, 3 mm and 5.5 mm below the base. Preferably, the apparatus is optimised to print on substrates in a positional range of 1 mm to 5.5 mm below the base i.e. between lines B and D. It will be noted that, in this region, the sensors responses as a function of print head position are substantially linear.

In operation, with the substrate 16 in place, the print head 10 is moved towards the substrate and, when the print head comes into contact with the substrate, the print head will stop moving. Any further rotation of the stepper motors 26 will result in an increased level of pressure, and compression of the springs 25. The force required to compress the springs 25 will be equal to the force exerted by the print head onto the substrate 16.

Figure 6:
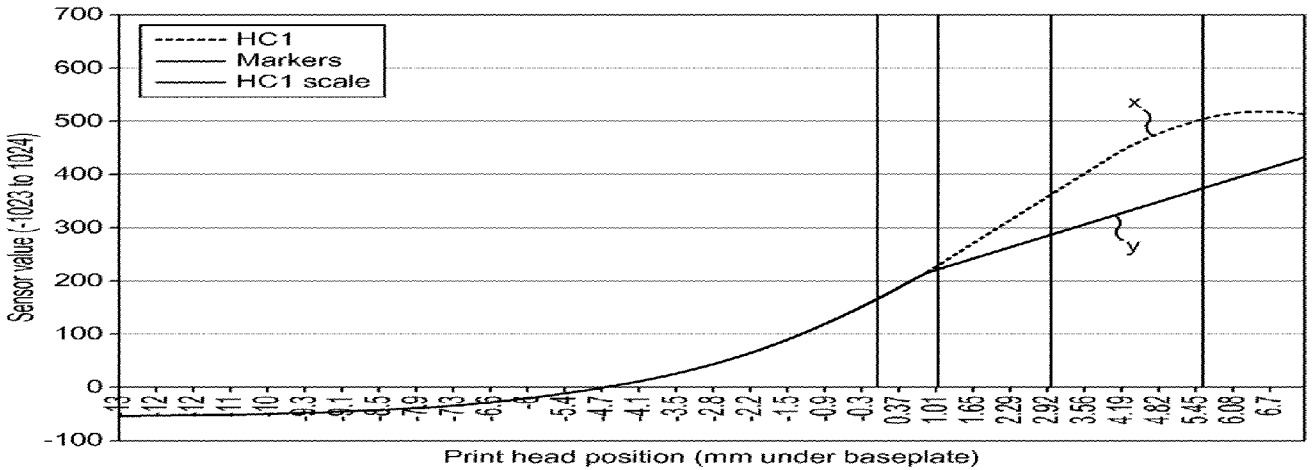
FIG. 6: shows the response of one sensor as a function of print head position both during calibration and in real time with a substrate present.

Referring now to FIG. 6, when in use and with a substrate in place, the measured sensor output curve (y) will be lower than the calibration curve (x) value once the print head has engaged the substrate. According to the invention, the printer is programmed to continue rotating the stepper motors 26 until the difference between the stored values of the Hall effect sensors, and the measured values (x−y) reaches a predetermined level. The printer thus controls the pressure applied to the substrate by monitoring the output of the Hall effect sensors.

The invention has a number of advantages over the state of the art. If the substrate is compressible then the Hall effect sensor will register an increment at a reduced slope to that stored in its look-up table. By controlling the difference in sensor readings, the printer thus compensates for the compressibility of the substrate, which may change from print to print. If the distance of the substrate from the printer changes during a print, due for example to poor alignment of the substrate to the print head, then the print head will be retracted or extended in line with the feedback received from the sensor, to maintain good print quality.

As the print head is moved between positions A and B, a microcomputer collects data from the sensors 39 and it is assumed that the difference in the position of the rail bar 22, compared to the position the rail bar would occupy in the absence of a substrate, is representative of the deflection of the springs 25 and hence the pressure applied to the substrate. The pressure is therefore controlled by a control loop which maintains the calculated difference values by adjusting the stepper motors 26 in response to feedback from the rail bar position sensors 39.

In the embodiment described it will be noted that the responses of the Hall sensors are non-linear with respect to the distances between the sensors and the respective magnets positioned on the rail bar. The sensor response curve generated by traversing the carriage 11 in a vertical direction is thus determined as a function of step number from the stepper motor. In use the response curve is compared to the feedback from the sensors and is thus used to control the stepper motor position. Thus the embodiment described will allow a uniform pressure to be applied independent of substrate thickness and substrate hardness as, in contrast to the prior art, the invention allows a variable number of stepper motor steps to be applied in response to the sensor feedback.

Figure 7:
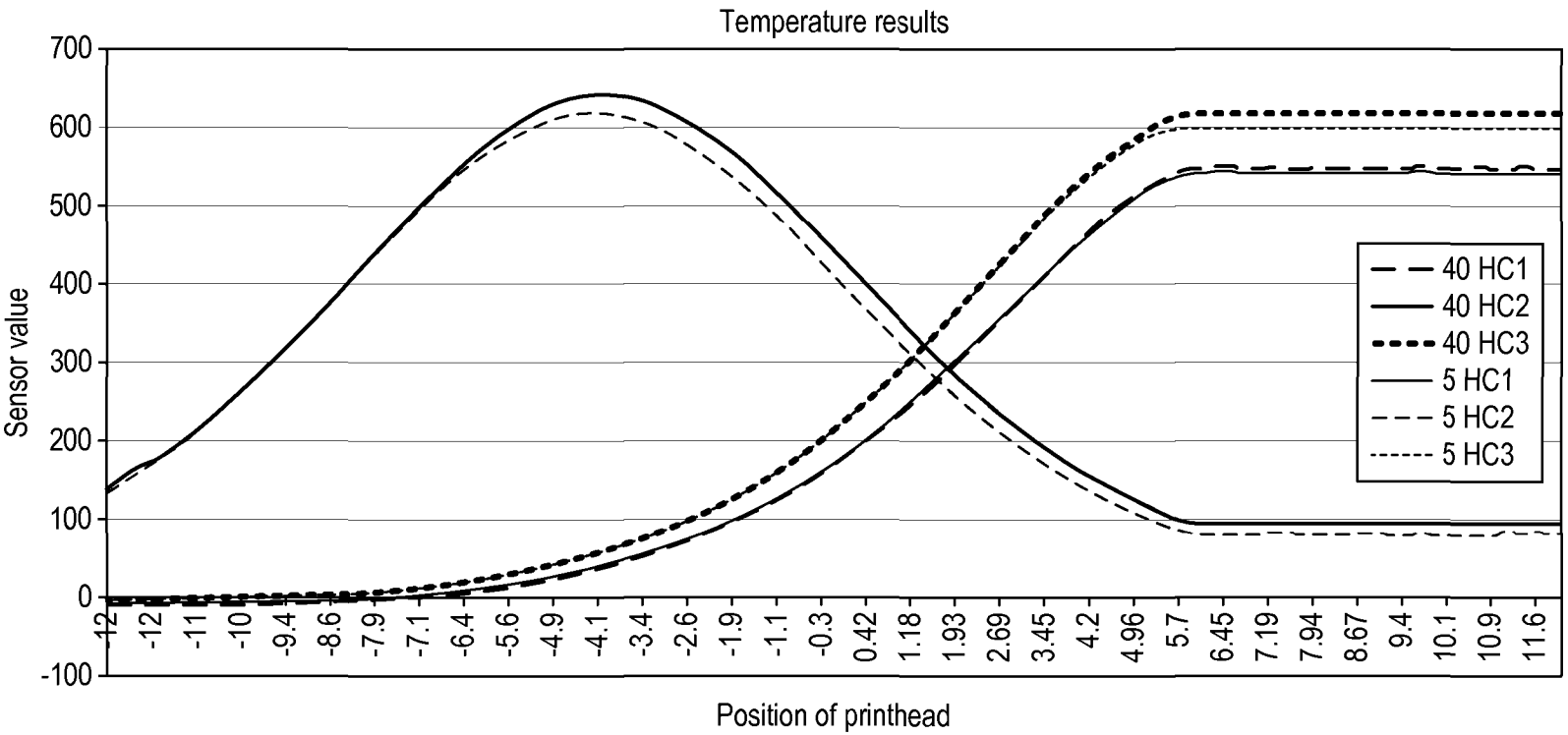
FIG. 7: shows the variation with temperature of the responses from the three sensors whose outputs are shown in FIG. 5.

FIG. 7 shows the response of a Hall effect sensor, as used herein, with temperature and illustrates some drift between values measured at 5° C. and 45° C. It is therefore important that the initialisation curve taken to characterise Hall effect sensor output as a function of print head displacement is measured at the beginning of a run.

Operating the printer in a variable-temperature environment in this manner could lead to reduced print quality due to errors in measuring pressure and so it is possible to configure the printer to run in an alternative mode for such variable-temperature environments. In the alternative mode, an initialisation procedure to measure the Hall sensor response relative to displacement is not required. Instead the printer is restricted to print between regions C and D only, for example by using a mechanical arrangement to fix a space between the base and the substrate. When the print head is traversed between regions B and C it can be observed from FIG. 5 that the Hall sensor response is substantially linear with respect to displacement. The printer is thus able, by collection of Hall sensor readings and displacement position whilst traversing the print head in the vertical direction, to determine the slope of this linear region. This slope can then be extrapolated into a theoretical line with which to establish a Hall effect sensor response target value for pressure control as described above.

It can be seen, by examining the temperature drift experienced by the sensor in FIG. 6, that although the sensor value changes, the response of the Hall sensor has a linear region that is independent of temperature. By determining the target slope during every retraction and extension of the print head, the printer is therefore able to collect data to maintain the pressure control mechanism independently of temperature.

The invention claimed is:

1. A method of controlling the pressure applied by a print head forming part of a thermal transfer printing apparatus, said apparatus including a support surface for the substrate to be printed, a thermal printing head, and drive means to move said thermal printing head towards said support surface, said drive means including a resiliently deformable member which undergoes deformation upon said printing head contacting a substrate on said support surface, wherein said method comprises, while said printing head is moving into contact with said substrate, sensing the position of said print head and the deformation of said resiliently deformable member.

2. A method as claimed in claim 1 wherein said drive means includes a stepping motor and wherein the deformation of said resilient member is determined using a control loop dependent upon the response of electro-magnetic sensors detecting magnets positioned to monitor the displacement of said print head.

3. A method as claimed in claim 2 further including undertaking a calibration function to ensure that deformation of said resilient member is determined when the responses of said electro-magnetic sensors as a function of printing head movement are substantially linear.

4. A method as claimed in claim 3 including undertaking a further calibration to ensure a constant deformation of said resilient member independent of temperature.

5. A method as claimed in claim 2 including undertaking a further calibration to ensure a constant deformation of said resilient member independent of temperature.

6. A thermal transfer printing apparatus comprising:

a support surface for the substrate to be printed;

a thermal printing head;

drive means to move said thermal printing head towards said support surface;

a resiliently deformable member within said drive means which undergoes deformation upon said printing head contacting a substrate on said support surface; and one or more sensors to monitor the position of said print head and the deformation of said resiliently deformable member as said printing head moves into contact with said substrate.

7. Apparatus as claimed in claim 6 wherein said one or more sensors comprise electro-magnetic sensors.

8. Apparatus as claimed in claim 7 wherein said electro-magnetic sensors comprise Hall effect sensors.

* * * * *

UNITED STATES PATENT AND TRADEMARK OFFICE

CERTIFICATE OF CORRECTION

PATENT NO. : 8,937,634 B2
APPLICATION NO. : 13/824557
DATED : January 20, 2015
INVENTOR(S) : Jonathan Morgan It is certified that error appears in the above-identified patent and that said Letters Patent is hereby corrected as shown below:

In the Specification

Column 1, line 50, “head is down” should be --head down--.

Signed and Sealed this
Seventh Day of July, 2015

Michelle K. Lee

Michelle K. Lee
*Director of the United States Patent and Trademark Office*